US006389637B1

(12) United States Patent
Hurell

(10) Patent No.: US 6,389,637 B1
(45) Date of Patent: May 21, 2002

(54) ABSORBENT BROOM COVER

(76) Inventor: Leona Hurell, 14890-88A Avenue, Surrey, British Columbia (CA), V3R 7T3

( * ) Notice: Subject to any disclaimer, the term of this patent is extended or adjusted under 35 U.S.C. 154(b) by 0 days.

(21) Appl. No.: 09/518,018

(22) Filed: Mar. 3, 2000

(30) Foreign Application Priority Data

Aug. 12, 1999 (CA) ..... 2280164

(51) Int. Cl.[7] ..... A47L 13/44
(52) U.S. Cl. ..... 15/247; 15/228
(58) Field of Search ..... 15/247, 228

(56) References Cited

U.S. PATENT DOCUMENTS

| | | | | |
|---|---|---|---|---|
| 960,158 | A | | 5/1910 | Cummings et al. |
| 964,402 | A | | 7/1910 | Davis |
| 1,360,926 | A | | 11/1920 | Glenn |
| 2,269,424 | A | | 1/1942 | Bernstein |
| 2,288,592 | A | * | 7/1942 | Mirhige |
| 2,562,230 | A | * | 7/1951 | Bernbaum |
| 2,709,824 | A | * | 6/1955 | Hall |
| 2,815,521 | A | * | 12/1957 | Winckler |
| 2,963,731 | A | | 12/1960 | Hoots ..... 15/247 |
| 3,166,775 | A | * | 1/1965 | Cushman |
| 3,462,790 | A | * | 8/1969 | Lingle |
| 5,042,105 | A | * | 8/1991 | Buck et al. |
| 5,138,738 | A | * | 8/1992 | Nicholson |
| 5,709,006 | A | * | 1/1998 | Carter |

FOREIGN PATENT DOCUMENTS

GB 2255900 A * 11/1992

* cited by examiner

*Primary Examiner*—Terrence R. Till
(74) *Attorney, Agent, or Firm*—Christie, Parker & Hale, LLP

(57) ABSTRACT

An absorbent broom cover for use with a household broom, particularly for cleaning surfaces. The cover comprises a sheet of doubled-over material and a securing portion. Portions of the doubled-over sheet are attachable and together define a proximal opening. The securing portion has a pair of elastically resilient strips attached to opposite faces of the tapered ends. The first strip folds up and over the second strip during engagement, thereby securely fastening the cover in place.

11 Claims, 7 Drawing Sheets

ABSORBENT BROOM COVER

BACKGROUND OF THE INVENTION

This invention relates to a broom cover for use with common household brooms, the cover being particularly adapted for use with a variety of broom configurations.

Household brooms comprise a handle member cooperating with a broom head that extends proximally from the handle. For normal use, brooms are limited to brushing and sweeping and the adaptation of the broom for use as an absorbent cleaning device requires the use of a broom head cover. This simple approach has many limitations and there are many patents disclosing the use of covers which cooperate with the conventional broom head to allow for adaptation of the broom for use in other cleaning adaptations.

U.S. Pat. No. 3,462,790 (Lingle) discloses a soft nap cloth cover for a broom. The cover includes gathered elasticized ends which are secured together by means of snap fasteners. The cover includes open sides for covering broom heads of various sizes.

U.S. Pat. No. 2,963,731 (Hoots) discloses a broom cover that includes a fabric sleeve that has a stretchable band at the upper end thereof. The stretchable band relies its inherent elasticity to hold the fabric sleeve in position. The band merely slips over the broom head and when in combination with the fabric sleeve, hold the cover in place.

U.S. Pat. No. 1,360,926 (Glenn) discloses an open-sided mop cover for a broom. The cloth covers of conventional brooms are designed to be attached to the broom head using conventional fasteners.

It is often difficult to maintain an adequate mounting of the broom cover on the broom head by use of the conventional fasteners.

Thus, there is a need for a broom head cover or accessory that can be used with household brooms, that can be easily attached and secured in place, and be used in a variety of household cleaning applications,

SUMMARY OF THE INVENTION

The invention reduces the difficulties and disadvantages of the prior art by providing a simple absorbent broom cover that can be manufactured using conventional materials at relatively low cost and is easily adaptable for a variety of household applications. The cover is small, lightweight, soft and very absorbent, durable, inexpensive and provides reliable firm retention on the broom head. The cover provides a secure and simple means of attachment to a household broom and thus reduces relative movement of the cover therebetween. In addition, the invention provides a novel method of attachment of the cover to the broom frame in such a way that the cover engages the broom head more tightly than previously described covers and thus enhances its versatility. The previously described relative movement between the cover and the broom frame is thus reduced considerably or essentially eliminated, thus reducing time spent readjusting the broom cover.

The cover may be constructed of different types of material, for example spandex with non-woven, (e.g., polar fleece, acrylic lambswool) or spandex with woven, (e.g., terry cloth). This cover when made of polar fleece (acrylic) is electrostatic and may be used for dry mopping dust on a variety of surfaces.

By changing the covering fabric, the broom may be used for light mopping to heavy duty mopping of floors and other surfaces that range from smooth surfaced to rough surfaced (e.g., lino, hardwood, ceramic tile, vehicle interiors and windows). The size of the cover would be advantageous where storage of cleaning devices is a problem, for example, in recreational vehicles, boats, cabins, home-cleaning crews, and hotel room cleaning carts.

The cover is attached to the broom head by means of spandex strips sewn to the fabric. The spandex strips are sewn at the ends to create pockets which, when they are engaged, overlap the broom head to firmly secure the broom in place. As an alternative, a one-way stretch elastic strip may be substituted for the multi-dimensional elastic spandex. The sides of the cover are left open and unstitched to allow very easy insertion of the broom. Because the broom bristles are flexible within the fabric pouch, more fabric surface is allowed to have contact with the surface to be cleaned. The broom inside the cover allows for a "mopping/sweeping" motion in which a pile of small debris can be picked up by simply pressing the fabric onto the debris, thereby dispensing with the use of dustpans. Furthermore, the fabric cover does not push dirt around like a conventional sponge mop, but picks it up in the fabric. Moreover, there is no handle for squeezing out the cover on the broom therefore the risk of damaging to the bottom of cabinets, is substantially reduced, if not eliminated. The ease of attachment/detachment of the cover allows it to be removed, rinsed and replaced onto the broom head.

In addition to covering the bristles, the cover also covers the broom head. This has the added advantage of protecting surfaces from scratches when the broom head is used to remove stubborn dirt or "hard spots". With the cover in place, the mop remains in "skinny" and can be used in between cabinets and stationary appliances (e.g. refrigerator and stove).

An absorbent broom cover according to the invention is for use with a broom and comprises a sheet of material and a securing portion. In the first embodiment, the sheet of material is folded to form a doubled-over sheet, portions of the sheet being attachable so that a proximal edge of the sheet defines an opening, the doubled-over sheet having an internal surface and an external surface. The securing portion is located adjacent the opening of the doubled-over sheet, the securing portion having an elastically resilient strip, the strip is being attached to the external surface adjacent the opening. The strip is attached to the proximal edge of the sheet at circumferentially spaced apart end locations, the strip being attached to the external surface at vertically spaced apart positions at each of the end locations so that the securing portion defines a pocket on the external surface.

Preferably, the sheet of material has a pair of tapered halves adjacent each other in the doubled-over sheet, each half having an end portion, the end portions being attached to each other to define the opening therebetween, the end portions having the proximal edge adjacent a proximal opening. The doubled over sheet is generally of sufficient size and flexibility to cooperate with the broom head.

Preferably, the doubled-over sheet has an intermediate edge portion and a distal edge portion. The intermediate edge portion defines a pair of side openings, the openings being generally perpendicular the proximal opening. The distal edge portion is continuous with each of the tapered halves.

Preferably, the elastically resilient strip has a proximal edge, a pair of end locations and a distal edge. The proximal edge is attached to at least a portion of the proximal edge of the proximal opening. The end locations are attached to the tapered halves by an attachment, the attachment is generally vertically spaced adjacent the proximal edge of the proximal opening, the attachment having an upper portion, a lower portion. The distal edge is attached to at least a portion of the proximal edge of the proximal opening and has at least a portion of the distal edge unattached. The combination of the attached proximal edge, the attached side portions and the unattached distal edge portion defines a pocket. The pocket is positioned generally opposite the distal edge attached to the proximal edge of the proximal opening. The pocket is located on an outer portion of the tapered end, the pocket being interchangeable between a non-engagement position and an engagement position. The lower portion of the attachment moves up and over the upper portion of the attachment, such that the lower portion becomes the upper portion and the upper portion becomes the lower portion in the engagement position.

More preferably, the securing portion further comprises a pair of elastically resilient strips. The first strip is located on the external surface adjacent the opening. The second strip is located on the internal surface adjacent the opening, both strips being generally opposite each other. Each of the strips has a proximal edge, a pair of side edges and a distal edge. The proximal edge is attached to the proximal edge of the proximal opening. Each side edge is attached to the tapered halves by an attachment, the attachment being generally vertically spaced adjacent the proximal edge of the proximal opening, the attachment having an upper portion and a lower portion. The distal edge is unattached, the edge being adjacent to the tapered half. The side edges are each attached to the proximal edge portions of each tapered half, the proximal edge portions being attachable to each other along the same edge as each of the side edges. The combination of the attached proximal edge, the attached side edges and the unattached distal edge defines a pair of pockets. The first pocket is located on an outer portion of the tapered end, the second pocket is located on the inner portion of the tapered end. The pockets are generally positioned opposite each other. The first pocket is interchangeable between a non-engagement position and an engagement position. The lower portion of the attachment moves up and over the upper portion of the attachment, such that the lower portion becomes the upper portion and the upper portion becomes the lower portion in the engagement position.

A detailed disclosure following, related to drawings, described preferred embodiments of the invention which is capable of expression in structure other than that particularly described and illustrated.

BRIEF DESCRIPTION OF THE DRAWINGS

In drawings that illustrate embodiments of the invention.

DETAILED DESCRIPTION

Figure 1:
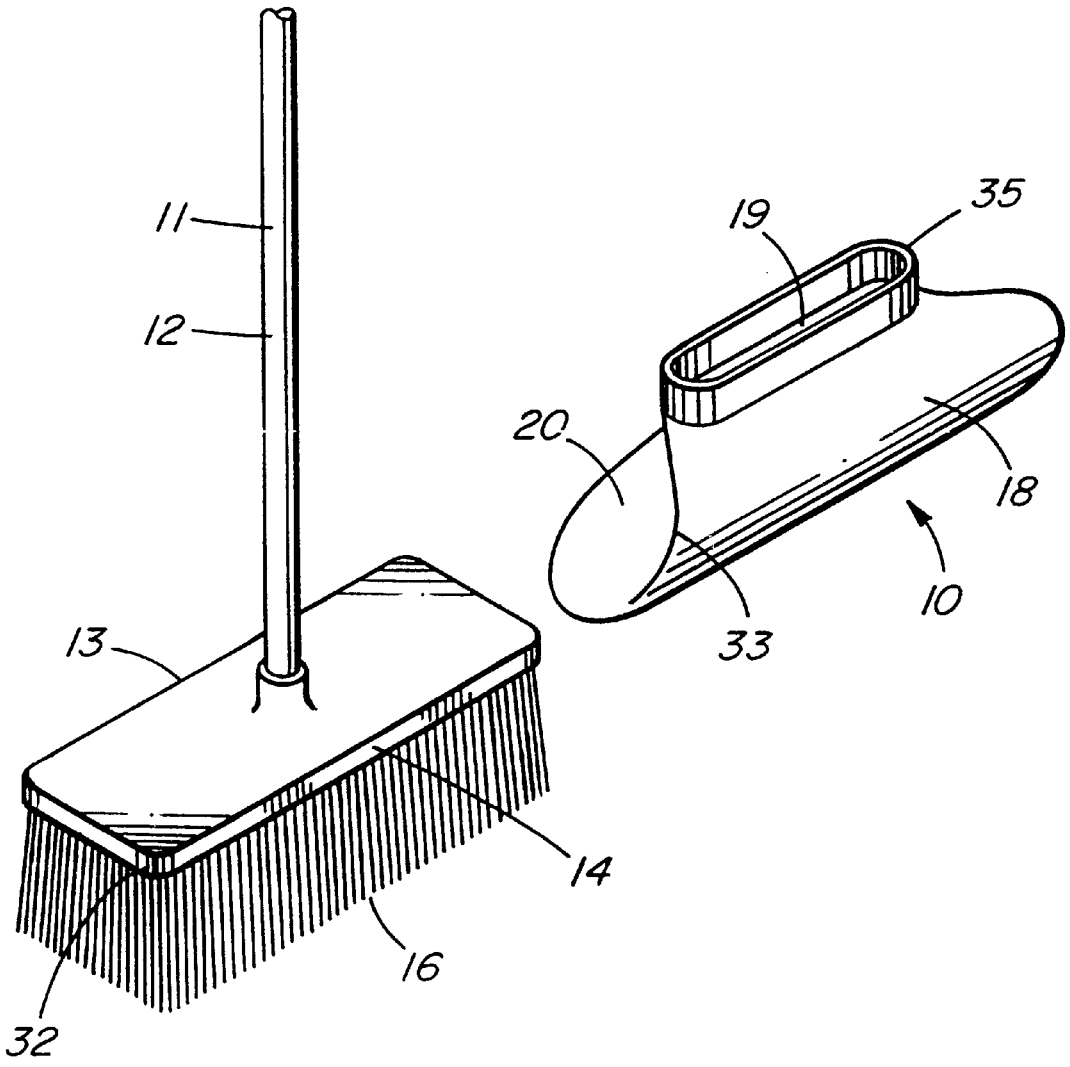
FIG. 1 is a perspective view of a first embodiment of the invention showing a room cover adjacent a broom to which it is to be engaged.
Figure 2:
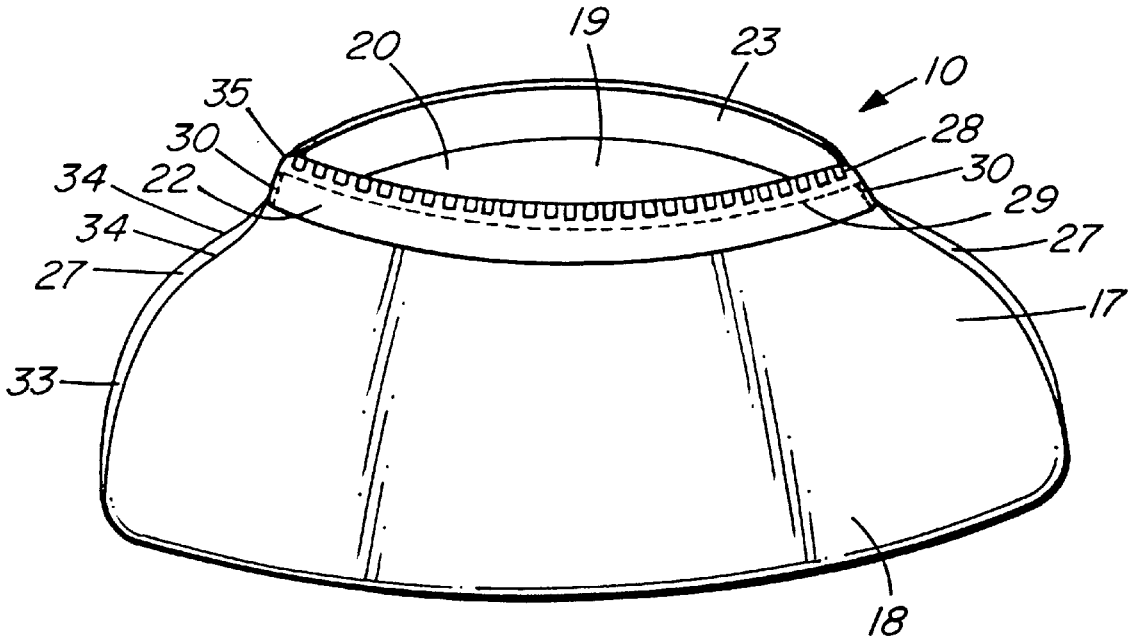
FIG. 2 is a perspective view of the first embodiment in an inoperable intermediate position.

FIGS. 1 and 2

The first embodiment 10 of an absorbent broom cover according to the invention is for use for cleaning surfaces and is shown adjacent a household broom 11 with which it is to engage. The broom has a handle 12 and a broom head 13 with a plurality of bristles 16 extending proximally therefrom. The broom head 13 has a plurality of edges 14 with a corresponding plurality of corners 32. The bristles 16 cooperate with an internal surface 20 of a doubled-over sheet of material 33 when the head is covered.

The first embodiment 10 comprises the doubled-over sheet of material 33 that is cut at opposite ends to form a pair of tapered halves 34. The doubled-over sheet 33 thereby defines a proximal opening 19, the internal surface 20 and an external working surface 18. One skilled in the art will recognize that the proximal opening 19 may be defined by a permanent attachment (e.g., by stitching) or a semi-permanent attachment (e.g., velco strips, snap fasteners, etc.).

The first embodiment comprises a securing portion 35 located adjacent the proximal opening 19 of the doubled-over sheet, the securing portion 35 having a pair of elastically resilient strips 22 and 23. The strips are located on the tapered halves of the sheet, and are cooperable with the broom head 13 so as to secure the doubled-over sheet to the broom head, as will be described. The tapered halves 34 are adjacent each other when the sheet is doubled-over.

FIGS. 3–7

The doubled-over sheet 33 has a distal edge portion 102 which is continuous between each of the tapered halves. An intermediate edge portion 101 which defines a pair of side openings 27, the openings being generally perpendicular the proximal opening 19 and a proximal edge portion 26 having a proximal edge 40 and a plurality of intermediate edges 41. During construction, a row of stitching 30 is applied down the edges 41 thereby defining the generally vertical openings 27 which are generally perpendicular to the proximal opening 19. Furthermore, the openings are of sufficient size and flexibility to permit positioning of the doubled-over sheet over the broom head 13 during the initial installment of the cover 10, as will be described in FIG. 7.

Figure 4:
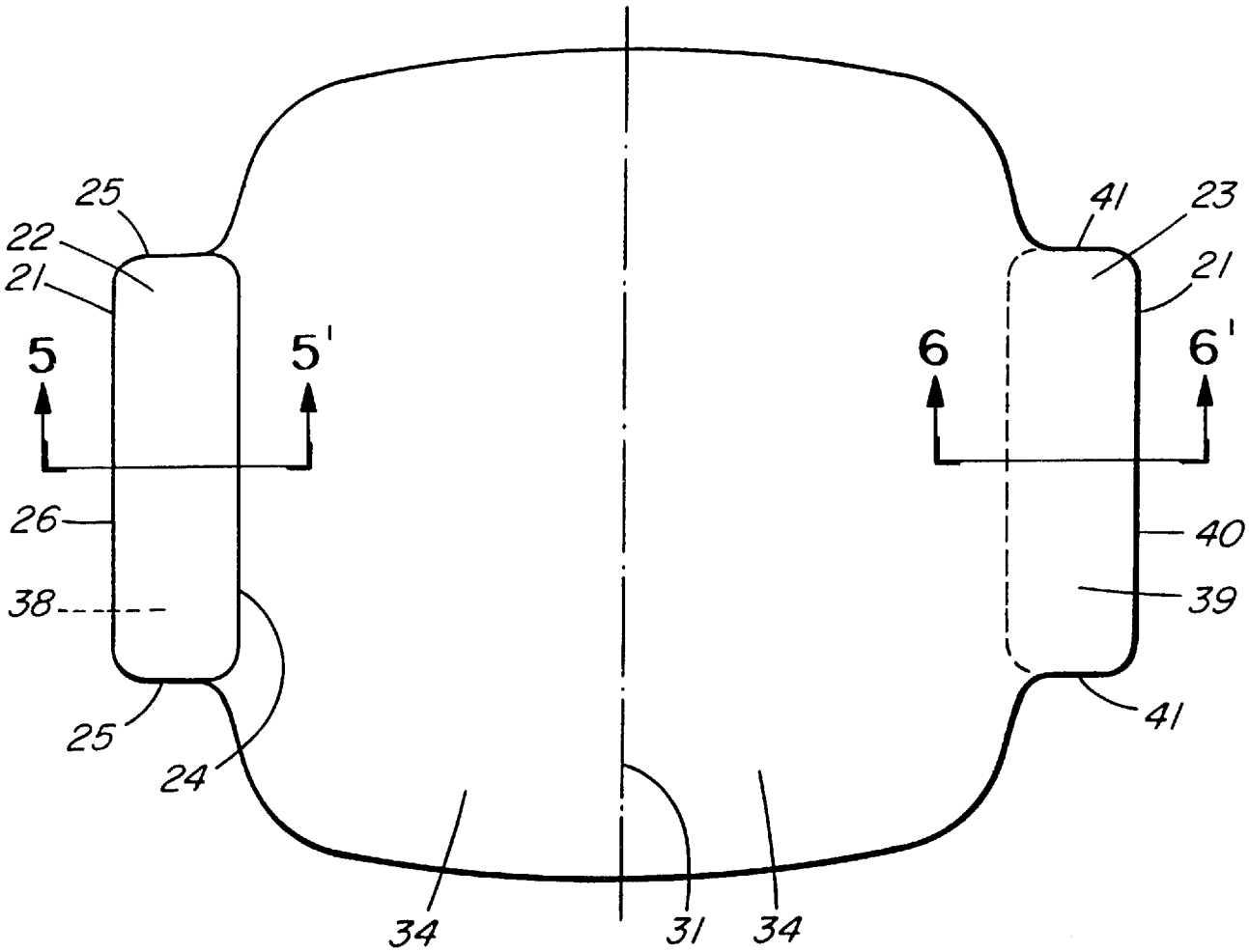
FIG. 4 is a simplified pattern of the first embodiment showing a folding axis.

As best seen in FIG. 4, the halves having each a pair of tapered ends 21, the end portions being attached to each other in such a way so as to define the proximal opening 19 therebetween. Moreover, the sheet halves are folded over about a folding axis 31 which positions the two tapered ends 21 adjacent each other during construction of the first embodiment 10.

The elastically resilient strips 22 and 23 each have a proximal edge 40 which is attached the proximal edge 26 of the proximal opening 19. A side edge 25 is attached to the tapered halves, the attachment being generally vertically spaced and are adjacent to the proximal edge 40 of the proximal opening 19. This leaves a distal edge 24 which is unattached and is adjacent to the tapered end. Each strip is attached by a row of straight stitching 29 and a row of C-shaped stitching 28. The C-shaped stitching 28 allows secure fastening, while maintaining multi-directional elasticity across the proximal edge, thereby allowing easy insertion of the broom head therebetween.

Figure 5:
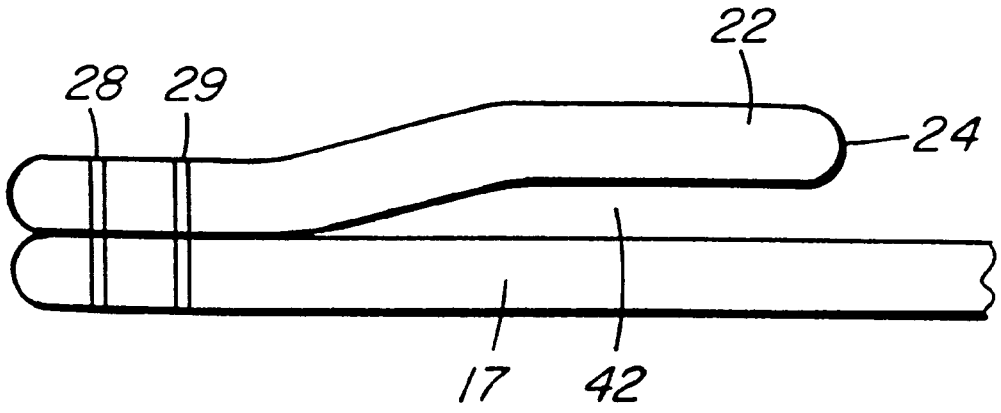
FIG. 5 is a simplified longitudinal section through line 5–5'.
Figure 6:
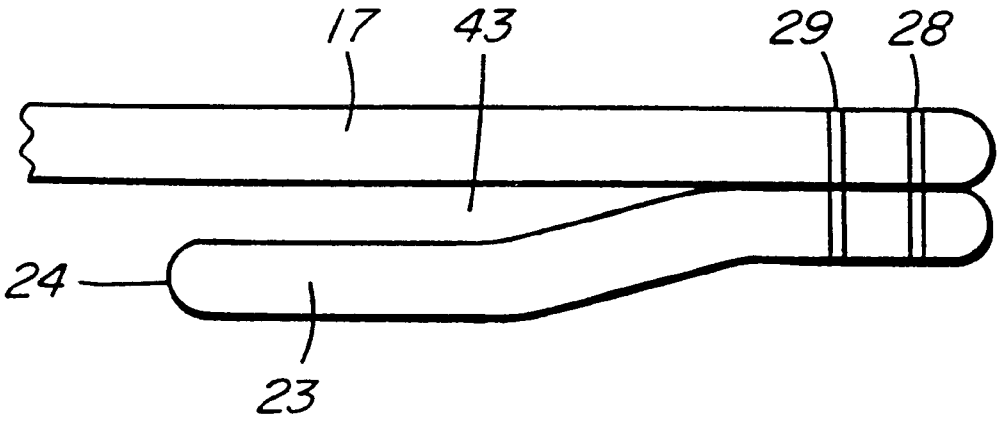
FIG. 6 is a simplified longitudinal section taken through line 6–6'.

Referring to FIGS. 4, 5 and 6, the combination of the attached proximal edge 26, an attached side edge 25 and the unattached distal edge 24 defines a pair of pockets 42 and 43 which are pockets positioned generally opposite each other. The first pocket 42 is located on an outer portion 38 of the tapered end, the second pocket 43 is located on an inner portion 39 of the tapered end. The first pocket 42 can interchange between operable and inoperable portions as will be described below.

Figure 3:
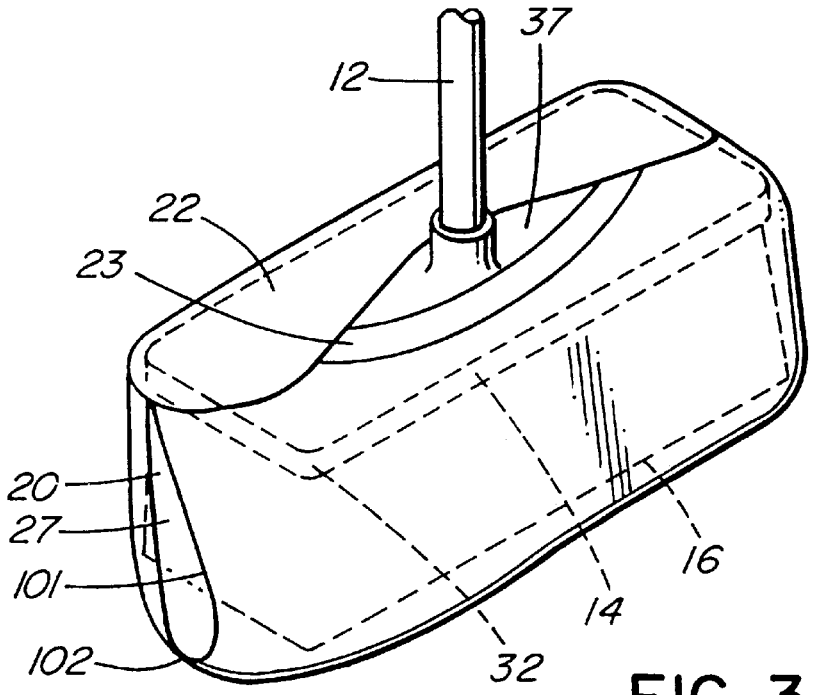
FIG. 3 is a perspective view of the first embodiment shown in operative mode cooperating with a broom.

The cover is secured over the broom head by folding the first pocket 42 over the second pocket 43 thereby securing the second strip 23 to the broom head is in the operable position. As best seen in FIG. 3, the internal surface 20 cooperates with the broom head 13 such that the external working surface 18 assumes the shape of the broom head when the securing portion 35 is engaged.

Operation

The cover 10 is usually supplied to the user in the inoperative position as shown in FIG. 2. With the doubled-over sheet 33 in the flat position and with the elastically resilient strips 22 and 23 fitted as shown in FIG. 2.

Figure 7:
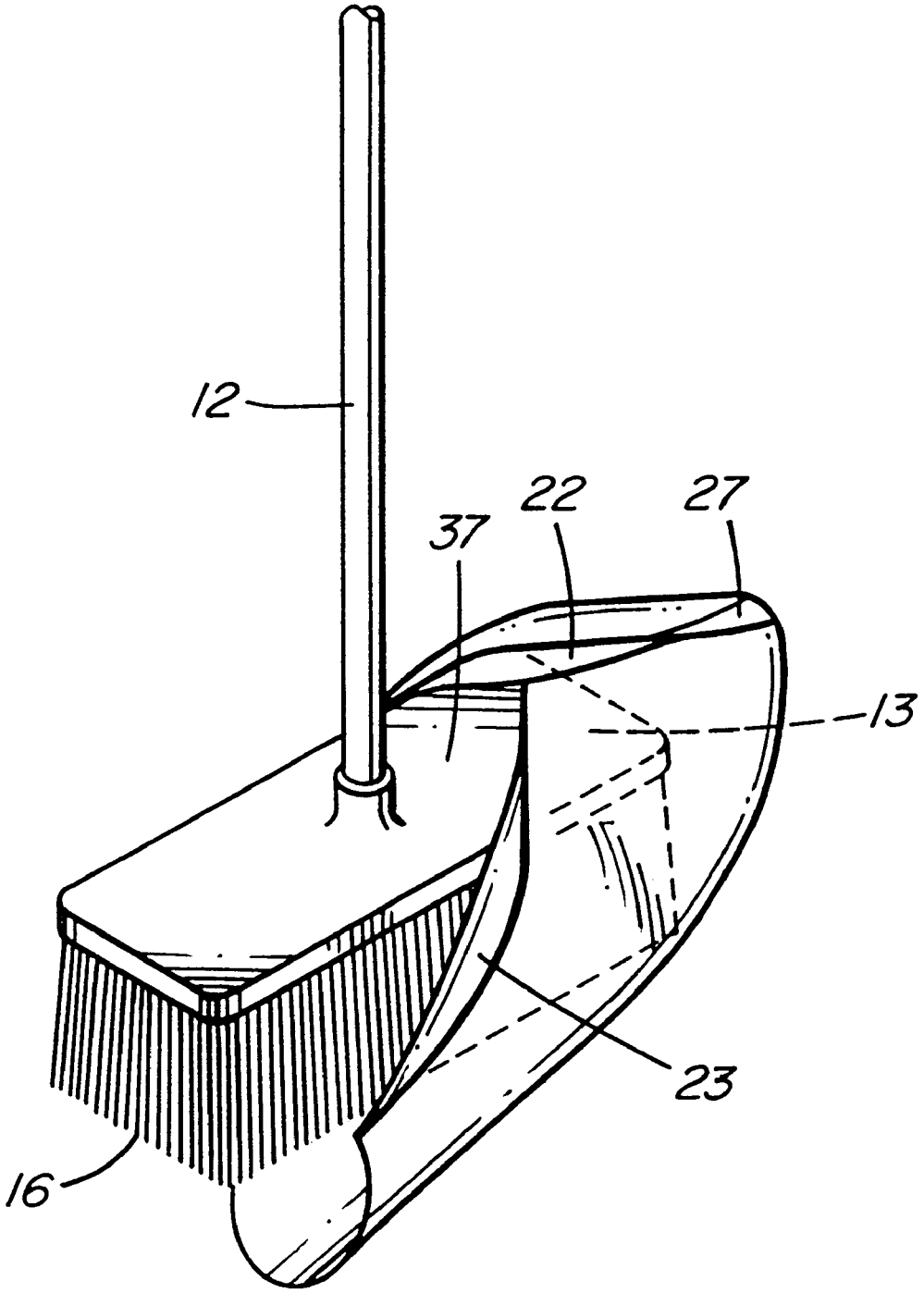
FIG. 7 is a perspective view of the first embodiment showing insertion of the broom head into the cover.

Referring to FIGS. 2 and 7, the user positions the proximal opening 19 over one end of the broom head. The broom head is inserted through the proximal opening, and the proximal edge of the proximal opening has a side and flexibility sufficient to cooperate with the broom head to produce a good fit. The broom head is positioned within the cover so that it cooperates with the internal surface 20. The perpendicular side openings 27 aid the broom head positioning for maximal cooperation of the bristles 16 with the internal surface. One skilled in the art will recognize that with sheets of material that are larger than the bristle area, a close fitting cooperation is not necessary. The elastically resilient strips 22 and 23 now cooperate with an upper surface 37 of the broom head 13 and in inoperable position are positioned such that the first strip 22 is disposed outwardly and the second strip 23 cooperates with the edge 14 and corners 32 of the broom head and the handle 12. The user first folds the first strip 22 over the broom head 13 and up to the handle 12. The user then folds the first strip 22 over the broom head 13 such that it overlaps the second strip 23. During this procedure, the lower portions of the attached strip move up and over the upper portions of the strip. This results in the lower portions becoming the upper portions and vice versa. The first strip 22 forms a tight cooperation across the length of the broom head and is particularly tight at the corners 32. Furthermore, securing the broom head 13 to the cover results in a firm coverage of the bristles 16 which is of sufficient resiliency to accommodate variations in the surface to be cleaned and yet firmly embrace the broom head so that the cover and the elastically resilient strips form a substantially stiff combination to resist twisting and slipping forces that might arise during operation.

A surface to be cleaned is contacted with the external working surface 18 of the covered broom head. The broom head is then used in the conventional manner by sweeping back and forth across the surface to be cleaned. Furthermore, the broom may be immersed in a cleaning solution and used as a mop to clean heavily-soiled surfaces.

It has been found that with sufficient pressure applied to compress the broom head, it is possible to clean heavily soiled, uneven surfaces without distortion of the covered head. The enhanced securing of the cover arises because the elastically resilient strips have sufficient size and resilience which, when subjected to the cleaning pressures, maintain tight cooperation with the broom head. Thus, the cover can operate in a variety of cleaning applications and permit improved use in inaccessible areas which are generally difficult to clean. Moreover, different fabrics used for the doubled-over sheet allow the broom head coverage to be interchangeable for a variety of cleaning applications (e.g. mopping or dusting).

Thus, in summary, the method of the invention comprises forming a secure coverage of a conventional broom head by overlapping elastically resilient strips, the first one of which cooperates tightly with the upper surface 37 of the broom head, the second overlaps the first thereby enhancing the fit.

Alternatives

Figure 8:
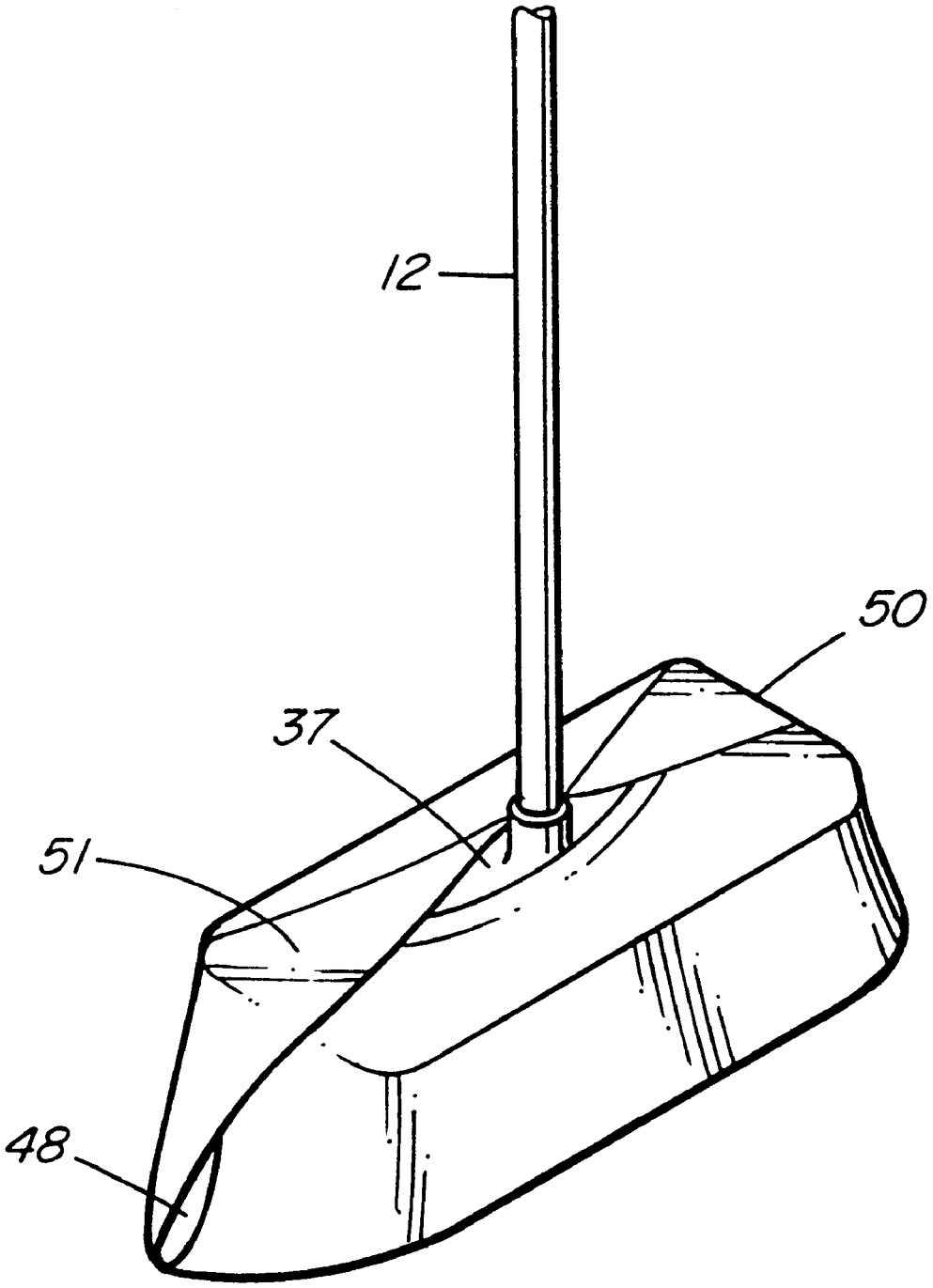
FIG. 8 is a perspective view of the alternative embodiment shown in operative mode cooperating with a broom indicating the position of the single elastically resilient strip.
Figure 9:
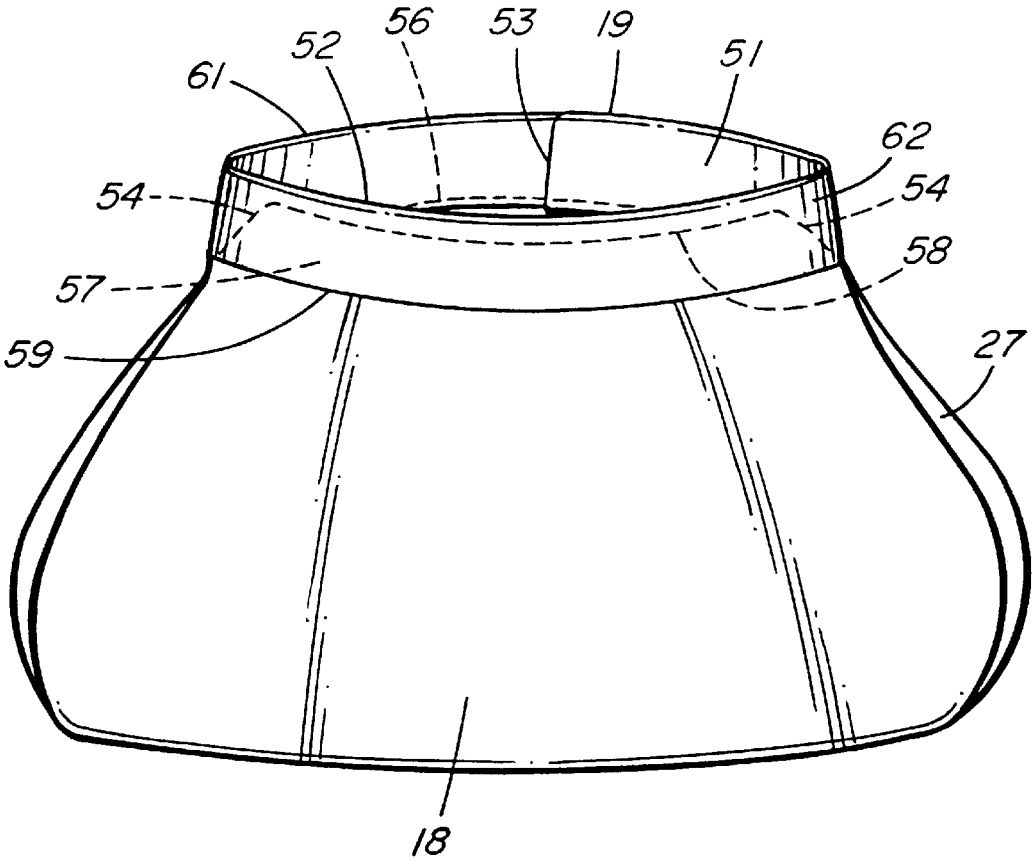
FIG. 9 is a perspective view of the second embodiment in an inoperable intermediate position.

FIGS. 8 and 9

The first embodiment of the device is shown for use with a household broom but it can also be used with an alternative elastically resilient strip arrangement in which the pair of elastically-resilient strips are replaced by a single strip. In a second embodiment, the securing portion 50 further comprises a single elastically resilient strip 51, the strip being attached to the proximal edge of the shet at circumferentially spaced apart end locations 62 and held together by a row of stitches 53. The strip has a proximal edge 52 which is attached to the proximal edge 40 of the proximal opening 19. One of ordinary skill in the art will recognize that the proximal edge 40 is attached to a portion of the proximal edge of the opening 19. The strip is attached by a generally vertical plurality of stitches 54 along one of the tapered halves 34. The stitches attach the strip to the tapered half along the pair of end locations 62. Furthermore, the strip is stitched by a row of stitches 58 such that the attached proximal edge 52, the stitches 54 and the unattached distal edge 59 defines a single pocket 57.

The pocket 57 is located on the outer portion of the tapered end and when folded over the non-pocketed strip portion 61, forms a tight cooperation with the broom head upper surface 37. The pocket 60 is cooperable with the non-pocketed strip thereby permitting movement relative thereto between operable and inoperable positions.

A procedure to secure the cover to the broom head is generally similar to that as previously described is as follows. After positioning the cover over the broom head (see FIG. 7) the broom head 13 and bristles 16 are positioned to fully cooperate with the internal surface 20 of the cover, the single elastically resilient strip 51 forms a tight cooperation with the upper surface of the broom head. In this alternative embodiment, the strip covers a larger surface of the broom head upper surface 37 than the first embodiment and may have greater application during heavy prolonged use. Once the cover and elastically resilient strip are secured, the remainder of the operation is essentially identical to that as previously described.

A third embodiment is envisaged in which a pair of elastically resilient strips are attached to the tapered halves. An outer strip has a pocket arrangement that is generally similar to that described above. The second strip is attached to the inner portion of the tapered end, is attached on all sides and does not have a pocket. The method of operation of this embodiment is generally similar to that as previously described.

What is claimed is:

1. An absorbent broom cover for use with a broom, the cover comprising:

a) a sheet of material folded to form a double-over sheet, portions of the sheet being attachable so that a proximal edge of the sheet defines an opening, the double-over-sheet having an internal surface and an external surface; and b) a securing portion located adjacent the opening of the doubled-over sheet, the securing portion having an elastically resilient strip, the strip being attached to the external surface adjacent to the opening, the strip having a proximal edge which is attached to at least a portion of the proximal edge of the proximal opening, the strip being attached to the proximal edge of the sheet at circumferentially spaced apart end locations, the strip being attached to the external surface at vertically spaced apart positions at each of the end locations so that the securing portion defines a pocket on the external surface, the strip having a pair of end locations which are attached to the sheet by an attachment, the attachment being generally vertically spaced adjacent the proximal edge of the proximal opening, the attachment having an upper portion, a lower portion, and the strip having a distal edge which is attached to at least a portion of the proximal edge of the proximal opening, at least a portion of the distal edge being unattached.

2. The cover as claimed in claim 1 in which:

a) the sheet of material has a pair of tapered halves adjacent each other in the doubled-over sheet, each half having an end portion, the end portions being attached to each other to define the opening therebetween, the end portions having the proximal edge adjacent a proximal opening, the opening having a size and flexibility sufficient to permit insertion of a broom head; and b) the doubled-over sheet is generally of sufficient size and flexibility to cooperate with the broom head.

3. The cover as claimed in claim 2 in which the doubled-over sheet has:

a) an intermediate edge portion which defines a pair of side openings, the side openings being generally perpendicular the proximal opening; and b) a distal edge portion which is continuous between each of the tapered halves.

4. The cover as claimed in claim 1 in which:

a) the combination of the attached proximal edge, the attached side portions and the unattached distal edge portion defines the pocket; and b) the pocket being positioned generally opposite the distal edge attached to the proximal edge of the proximal opening.

5. The cover as claimed in claim 4 in which:

a) the pocket is located on an outer portion of the tapered end, the pocket being interchangeable between a non-engagement position, an engagement position; and b) the lower portion of the attachment moves up and over the upper portion of the attachment, such that the lower portion becomes the upper portion and the upper portion becomes the lower portion in the engagement position.

6. The cover as claimed in claim 1 in which the securing portion further comprises:

a) a pair of elastically resilient strips, the first strip being located on the external surface adjacent to the opening, the second strip being located on the internal surface adjacent the opening, both strips being generally opposite each other.

7. The cover as claimed in claim 6 in which each strip has:

a) a proximal edge which is attached to the proximal edge of the proximal opening;

b) a pair of side edges, each edge being attached to the tapered halves by an attachment, the attachment being generally vertically spaced adjacent the proximal edge of the proximal opening, the attachment having an upper portion, a lower portion; and c) a distal edge which is unattached, the edge being adjacent the tapered half.

8. The cover as claimed in claim 7 in which:

a) the side edges are each attached to the proximal edge portions of each tapered half, the proximal edge portions being attachable to each other along the same edge as each of the side edges.

9. The cover as claimed in claim 7 in which each strip;

a) the combination of the attached proximal edge, the attached side edges and the unattached distal edge defines a pair of pockets.

10. The cover as claimed in claim 9 in which:

a) the first pocket is located on an outer surface adjacent the opening, the second pocket is located on the inner surface adjacent the opening, both pockets being generally opposite each other; and b) the first pocket being interchangeable between a non-engagement position and an engagement position.

11. The cover as claimed in claim 7 in which:

a) the lower portion of the attachment moves up and over the upper portion of the attachment, such that the lower portion becomes the upper portion and the upper portion becomes the lower portion in the engagement position.

* * * * *

UNITED STATES PATENT AND TRADEMARK OFFICE

CERTIFICATE OF CORRECTION

PATENT NO. : 6,389,637 B1
DATED : May 21, 2002
INVENTOR(S) : Leona Hurell

It is certified that error appears in the above-identified patent and that said Letters Patent is hereby corrected as shown below:

Title page,
Item [76], Inventor(s), name should read -- Leona Hurrell --

Signed and Sealed this

Eighteenth Day of March, 2003

JAMES E. ROGAN
*Director of the United States Patent and Trademark Office*